United States Patent [19]

Wolf

[11] 3,987,596

[45] Oct. 26, 1976

[54] FODDER SILO

[75] Inventor: Johann Wolf, Scharnstein, (Oberosterreich), Austria

[73] Assignee: Johann Wolf Gesellschaft m.b.H. KG, Scharnstein, (Oberosterreich), Austria

[22] Filed: Jan. 29, 1976

[21] Appl. No.: 653,458

[30] Foreign Application Priority Data

Feb. 3, 1975 Austria ..... 87767/75

[52] U.S. Cl. ..... 52/196; 49/40; 49/246; 49/465; 52/208; 52/213

[51] Int. Cl.[2] ..... E04H 7/26

[58] Field of Search ..... 49/246, 465, 504; 52/208, 196, 193, 701, 699, 213, 204

[56] References Cited

UNITED STATES PATENTS

| | | | |
|---|---|---|---|
| 1,168,156 | 1/1916 | Brubaker | 52/196 |
| 1,309,109 | 7/1919 | Strunk | 49/465 |
| 1,322,690 | 11/1919 | Griswold | 52/196 |
| 1,341,533 | 5/1920 | Atkins | 52/196 |
| 1,642,552 | 9/1927 | Millice | 52/216 |
| 1,882,942 | 10/1932 | Ross | 52/196 |
| 2,466,549 | 4/1949 | Landine | 52/208 |
| 3,048,946 | 8/1962 | Hawk et al. | 52/196 |

FOREIGN PATENTS OR APPLICATIONS

| | | | |
|---|---|---|---|
| 1,070,705 | 2/1954 | France | 52/208 |
| 589,463 | 12/1933 | Germany | 52/196 |
| 1,115,210 | 10/1961 | Germany | 49/246 |
| 686,195 | 1/1953 | United Kingdom | 49/465 |

*Primary Examiner*—Alfred C. Perham
*Attorney, Agent, or Firm*—Young & Thompson

[57] ABSTRACT

A concrete wall is formed with at least one discharge opening and has an outside surface and an inside surface formed with a recess which surrounds said discharge opening. A door-frame extends in said recess and has corners and a peripherally extending door abutment. A door is disposed in said discharge opening and engages said door abutment. Frame-clamping means are provided to force said door frame into said recess and comprise pins carried by said door frame at least at said corners and extending outwardly through said discharge opening, and clamping plates engaging said outside surface and cooperating with said clamping pins.

22 Claims, 5 Drawing Figures

Figure 1:
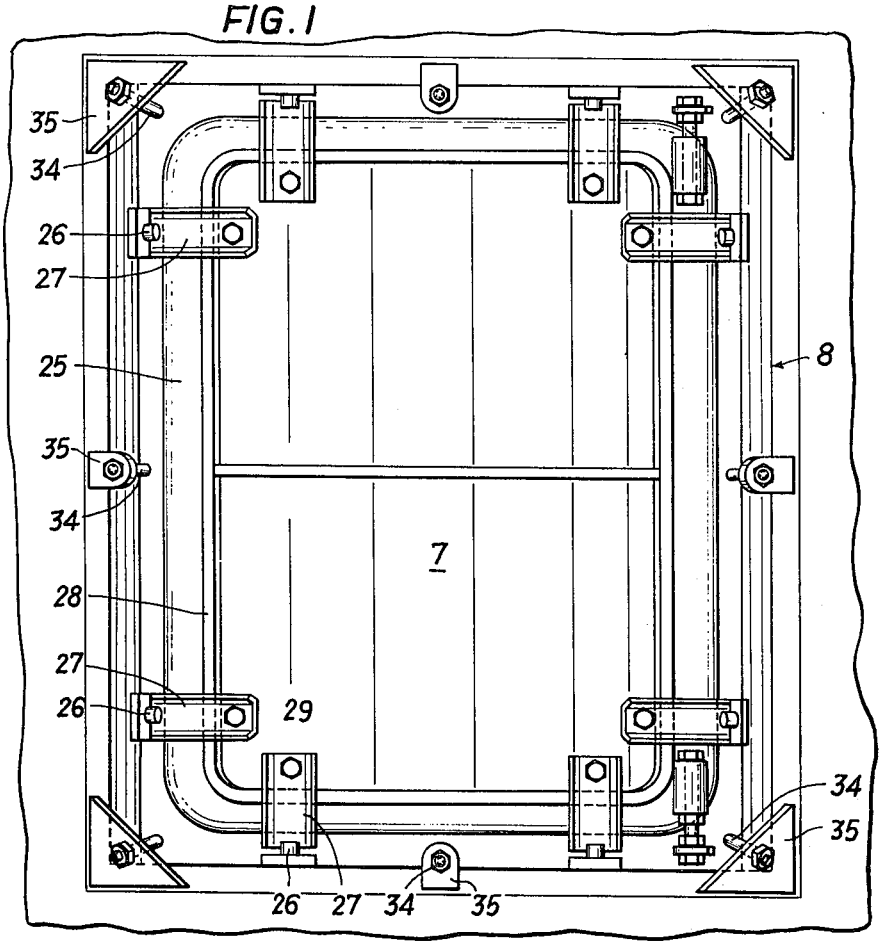

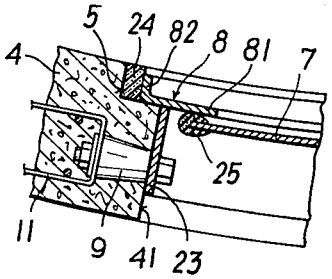
FIG. 3
FIG. 4
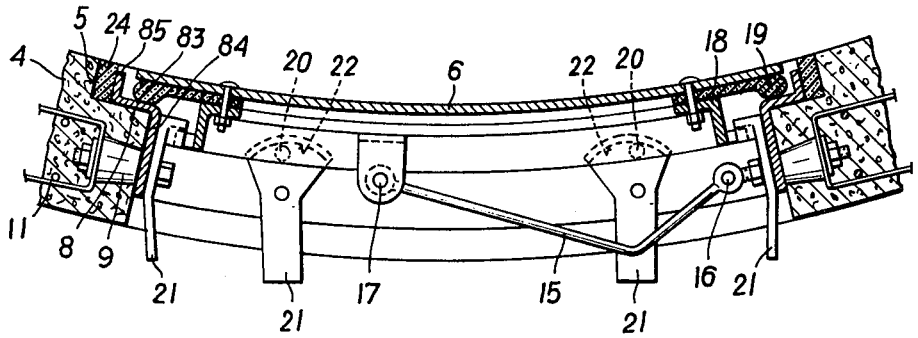
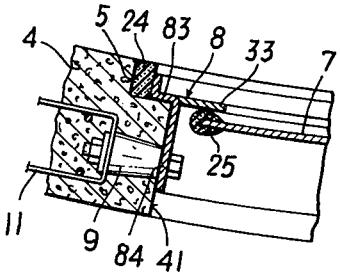
FIG. 5

FODDER SILO

This invention relates to a closure for discharge openings of fodder silos of concrete, which closure comprises an inwardly or outwardly opening door.

Fodder silos of concrete are cylindrical, closed at the top, and formed in the shell with vertically spaced openings through which fodder is discharged by hand or by mechanical unloaders, so-called silage unloaders. Before the silos are filled, the discharge openings must be gastightly closed by suitable, stable doors.

In known embodiments, a frame which surrounds the edge of the discharge opening is embedded in the concrete as the same is placed to form the silo and an inwardly or outwardly opening door, which conforms to the silo wall, is secured to said frame by wedges or screws, with a gasket interposed. To ensure a proper fermentation, the doors must be sealed well and for this reason must be forced against the frame by a plurality of spaced apart screw- or wedgetape connecting means provided at the periphery.

The fermentation process results in the production of acids which are highly aggressive and result in a rapid corrosion of the connecting elements and of the parts which protrude into the interior of the silo. The connecting means rust and can then be separated only with difficulty. It will be particularly inconvenient if the frames are destroyed which have been embedded in the concrete in the manner described hereinbefore. When these frames must be renewed, they must be chiselled out so that a highly expensive repair is involved.

It has been attempted to avoid corrosion in that the endangered parts are made of plastics material. These constructions are expensive and tend to age with formation of cracks, which result in leakage.

It is an object of the invention so to design a frame that the same can well be sealed in position and can easily be replaced and has a suitable surface for gastight engagement with a door.

In a closure of the kind defined first hereinbefore, this object is accomplished according to the invention in that a frame is provided, which is adapted to be inserted into a recess which surrounds the discharge opening on the inside of the silo, and said frame is provided at least at its corners with clamping pins, particularly screwthreaded pins, which extend through the discharge opening, clamping plates engaging the outside surface of the fodder silos are associated with said clamping pins, and the frame has peripherally extending abutment surfaces for the door.

The closure for discharge openings designed according to the invention facilitates the exchange of parts which are untight or have become unusable owing to corrosion, particularly of the frame. During the erection of the fodder silo from concrete, the recess on the inside surface of the silo can be formed in a simple manner. Within the scope of the invention, the frame inserted into said recess may have various shapes in cross-section, such as an angle section, a channel section or a Z-shaped section. According to a preferred feature of the invention, a space for receiving an elastic or plastic seal, known per se, is provided between the frame and the recess.

According to a further preferred feature of the invention, flanges or webs of the frame serve as abutments for an inwardly or outwardly opening door, and the frame is provided with means for forcing the door against the frame. These means provided within the scope of the invention facilitate the opening of the door so that ensilage can be discharged through the discharge openings.

Details of the invention, particularly of the design and mounting of the frame in such a manner that the same can easily be replaced, and of the mounting of the doors, also of the means for forcing the doors against the frame for a tight seal of the fodder silo, will be explained with reference to the accompanying drawings, in in which some embodiments of the closure for discharge openings according to the invention are shown diagrammatically and by way of example.

Figure 2:
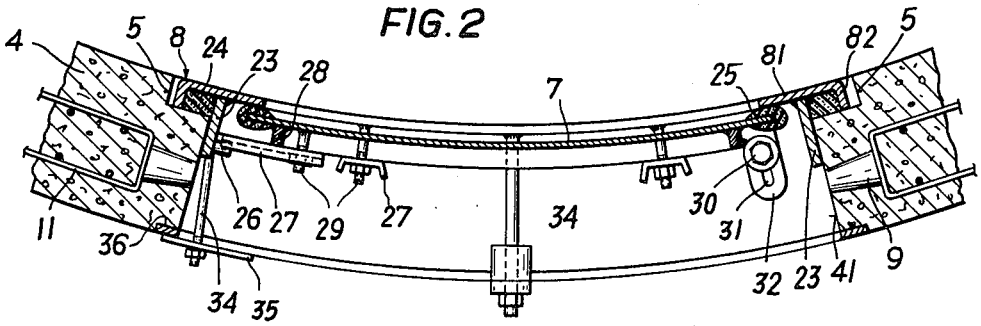

FIG. 1 is an elevation showing a closure viewed from the outside with the door inserted, FIG. 2 is a horizontal sectional view showing the embodiment of FIG. 1 with the connection of the closure to the wall of the fodder silo, FIG. 3 shows a detail of a closure of another embodiment, FIG. 4 is a transverse sectional view which is similar to FIG. 2 and shows another embodiment, and FIG. 5 shows a fourth embodiment of the closure.

In the embodiment of the closure of the invention shown in FIGS. 1 and 2, the silo wall 4 has a recess 5, which has been formed during the placing of the concrete of the fodder silo. A frame 8 which is inserted in said recess 5 is L-shaped in cross-section and has lugs 23 or ribs which engage the reveal 41 of the discharge opening. A space for receiving a gasket 24 or sealing compound is provided between the approximately radially extending flange 82 of the frame 8 and the recess 5. The frame 8 is forced into the recess 5 by clamping pins, particularly screw threaded pins 34, which extend through clamping plates 35, which engage the outside surface of the silo wall 4, with a bearing frame 36 interposed, if desired. Such screw-threaded pins 34 are preferably arranged at the corners of the discharge openings and in that case cooperate with clamping plates 35 which are triangular in cross-section. Such screw-threaded pins are suitably arranged also on the sides of the discharge opening, as is shown in FIG. 1.

A reinforcement 11 is provided on the silo wall 4 and is secured to anchors 9.

The peripherally extending flange 81 of the frame 8 constitutes an abutment for an outwardly opening door 7. In accordance with FIGS. 1 and 2, means for forcing this door against the flange 81 comprise abutments 26, e.g., pins, which are secured to the lugs 23 or ribs, and clamping levers 27, which engage said abutments 26 and bear on abutments 28 secured to the door 7, these abutments 28 consist of a peripherally continuous stiffening rib on the outside of the door 7. By means of turnbuckles 29 secured to the door 7, the clamping levers 27 are pulled toward the door 7 and thus force the door against the abutment surface. An elastic gasket 25 extends around the edge of the door 7 and serves to seal the same. The door 7 may be removable or, as shown in FIGS. 1 and 2, may be adapted to be swung out. For this purpose the door 7 is provided with hinge pins 30, which engage slots of brackets 32 secured to the frame 8.

It is shown in FIG. 3 that a frame 8 which is L-shaped in cross-section may be arranged so that its peripherally extending flange 81 engages the peripherally extending surface of the recess 5 and a space for receiving a seal 24 is left between the radially extending flange 82 and the recess 5. In that embodiment too the frame 8 is provided with lugs 23 or ribs, which engage the reveal 41 of the discharge opening and may be provided in the manner shown in FIGS. 1 and 2 with means for forcing the door 7 against the flange 81 of the frame 8. The frame 8 is forced into the recess in the manner described with reference to FIGS. 1 and 2.

FIG. 4 shows a frame 8 which is Z-shaped in cross-section and has an approximately peripherally extending web 83, which is forced against the codirectional surface of the recess 5 by means of screw-threaded pins and clamping plates similar to those shown in FIGS. 1 and 2. A gasket 24 or a plastic sealing compound for sealing the frame 8 against the silo wall 4 is provided between the approximately radially extending flange 85 and the recess 5. The other flange 84 engages the reveal 41 of the discharge opening. An inwardly opening door 6 can be forced against an abutment consisting of the web 83 of the frame 8 by pins 20, which are secured to the door 6 and preferably to a stiffening frame 18 connected to said door, and by clamping members 21 having clamping surfaces 22 which engage said pins. The clamping members 21 are pivoted to the flange 84 of the frame 8 and provided at a plurality of positions on the sides of the closure. The stiffening frame 18 may be designed to clamp a gasket 19 in position, which serves to seal the door 6 against the web 83. The door 6 is hinged to the frame 8 by at least two links 15, which are hinged to a vertical side of the frame by hinges 16 and to the door 6 by hinges 17. When the clamping members 21 have been disengaged, the door 6 can be swung in against the inside surface of the fodder silo.

The frame 8 shown in FIG. 5 is Z-shaped in cross-section, as in FIG. 4, and in the manner described hereinbefore is forced into the recess 5 of the silo wall 4 by screw-threaded pins and clamping plates and is sealed against the silo wall 4 by a gasket 24. The Z-shaped frame has an extension 33, which constitutes an abutment for an outwardly opening door 7. In the manner which has been explained with reference to FIGS. 1 and 2, the door 7 can be forced against said extension 33, with a gasket 25 interposed.

The embodiment shown and described serve only for an explanation of the nature of the invention, which is not restricted to details.

What is claimed is:

1. A fodder silo, which comprises
a concrete wall formed with at least one discharge opening and having an outside surface and an inside surface formed with a recess which surrounds said discharge opening,
a door frame extending in said recess and having corners and a peripherally extending door abutment,
a door disposed in said discharge opening and engaging said door abutment, and
frame-clamping means for forcing said door frame into said recess and comprising clamping pins carried by said door frame at least at said corners and extending outwardly through said discharge opening, and clamping plates engaging said outside surface and cooperating with said clamping pins.

2. A fodder silo as set forth in claim 1, in which said door is adapted to be inwardly opened.

3. A fodder silo as set forth in claim 2, in which
said door frame has four sides, including two vertical sides,
at least two links are hinged to one of said vertical sides and to said door, and
door-clamping members are mounted on all four sides of the frame and engage said frame.

4. A fodder silo as set forth in claim 3, in which
said discharge opening has a reveal,
said frame has reveal-engaging sides engaging said reveal,
said door-clamping members are pivoted to said reveal-engaging sides on a pivotal axis and have clamping surfaces which are eccentric with respect to said pivotal axis, and
door-clamping pins are secured to said door and engageable by said door-clamping members.

5. A fodder silo as set forth in claim 3, in which
said door is provided on its outside with a stiffening frame which carries said door-clamping pins and
a seal is replaceably held between said door and said stiffening frame.

6. A fodder silo as set forth in claim 1, in which said door is adapted to be outwardly opened.

7. A fodder silo as set forth in claim 6, in which
said door is provided on the outside with first clamp abutments and with door-clamping members adapted to cooperate with said first clamp abutments,
said discharge opening has a reveal,
said door frame has reveal-engaging means engaging said reveal, and
said reveal-engaging means carry second clamp abutments engageable by said door-clamping members.

8. A fodder silo as set forth in claim 7, in which
said door frame carries brackets having slots and
hinge pins are connected to said door and received in said slots.

9. A fodder silo as set forth in claim 7, in which said door is provided on the outside with a stiffening rib which constitutes said first clamp abutments.

10. A fodder silo as set forth in claim 1, in which said clamping pins comprise screw-threaded pins.

11. A fodder silo as claimed in claim 1, in which
said door frame is L-shaped in cross-section and has a peripherally extending flange constituting said door abutment,
said discharge opening has a reveal,
said door frame has reveal-engaging means which engage said reveal,
said door frame has a second flange disposed in said recess and defining therewith a space, and
a seal is accommodated in said space.

12. A fodder silo as set forth in claim 11, in which said reveal-engaging means comprise lugs.

13. A fodder silo as set forth in claim 11, in which said reveal-engaging means comprise ribs.

14. A fodder silo as set forth in claim 11, in which said seal is elastic.

15. A fodder silo as set forth in claim 11, in which said seal is plastic.

16. A fodder silo as set forth in claim 1, in which
said recess has a peripherally extending surface,
said discharge opening has a reveal,
said door frame is Z-shaped in cross-section and has first and second flanges and a web connecting said flanges,
said web engages said peripherally extending surface,
said first flange engages said reveal,
said second flange and said recess define a space, and
a seal is accommodated in said space.

17. A fodder silo as set forth in claim 16, in which said seal is elastic.

18. A fodder silo as set forth in claim 16, in which said seal is plastic.

19. A fodder silo as set forth in claim 16, in which said door is adapted to be inwardly opened and said web constitutes said door abutment.

20. A fodder silo as set forth in claim 16, in which said door is adapted to be outwardly opened and said web has an extension which protrudes into said discharge opening and constitutes said door abutment.

21. A fodder silo as set forth in claim 1, which comprises a bearing frame which is interposed between said clamping plates and said outside surface and surrounds said discharge opening.

22. A fodder silo as set forth in claim 1, in which said door abutment in peripheral continuous and extends radially into said discharge opening.

* * * * *